US007546066B2

(12) United States Patent
Fujita et al.

(10) Patent No.: US 7,546,066 B2
(45) **Date of Patent: *Jun. 9, 2009**

(54) IMAGE FORMING APPARATUS, IMAGE FORMING SYSTEM, AND IMAGE FORMING METHOD

(75) Inventors: Toru Fujita, Nagano-ken (JP); Masahide Nakamura, Shiojiri (JP); Fuminori Yano, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/138,284

(22) Filed: Jun. 12, 2008

(65) Prior Publication Data

US 2008/0247771 A1 Oct. 9, 2008

Related U.S. Application Data

(63) Continuation of application No. 10/903,262, filed on Jul. 30, 2004, now Pat. No. 7,403,736.

(30) Foreign Application Priority Data

Aug. 20, 2003 (JP) ..... 2003-296755
Aug. 20, 2003 (JP) ..... 2003-296756

(51) Int. Cl.
*G03G 15/10* (2006.01)
*G03G 15/08* (2006.01)

(52) U.S. Cl. ..... 399/237; 399/53; 399/236

(58) Field of Classification Search ..... 399/53, 399/236, 237
See application file for complete search history.

(56) References Cited

U.S. PATENT DOCUMENTS

| | | | | |
|---|---|---|---|---|
| 6,539,188 | B2 | 3/2003 | Matsumoto et al. | 399/119 |
| 2002/0098016 | A1 | 7/2002 | Kurotori et al. | 399/237 |
| 2002/0101493 | A1 | 8/2002 | Tanaka et al. | 399/236 |
| 2003/0210918 | A1 | 11/2003 | Toizumi et al. | 399/53 |

FOREIGN PATENT DOCUMENTS

| | | |
|---|---|---|
| JP | 04-316849 | 11/1992 |
| JP | 05-232821 | 9/1993 |
| JP | 09-026704 | 1/1997 |
| JP | 2002-278292 | 9/2002 |
| JP | 2002-328533 | 11/2002 |
| JP | 2003-076148 | 3/2003 |

*Primary Examiner*—David M Gray
*Assistant Examiner*—Ryan D Walsh
(74) *Attorney, Agent, or Firm*—Hogan & Hartson LLP

(57) ABSTRACT

An image forming apparatus includes a turnable image bearing body for bearing a latent image; a turnable developer bearing body for bearing liquid developer, the developer bearing body and the image bearing body being pressed in contact with each other at a predetermined press-contact position, the developer bearing body being capable of carrying the liquid developer toward the press-contact position by turning, the image forming apparatus performing development of the latent image, which is bore by the image bearing body, with the liquid developer that has been carried toward the press-contact position; and a controller for causing the development of the latent image to start after a predetermined period of time has passed from when the turning speed of the developer bearing body and the image bearing body reached a predetermined turning speed for development at which the development is performed.

8 Claims, 10 Drawing Sheets

FIG. 5A
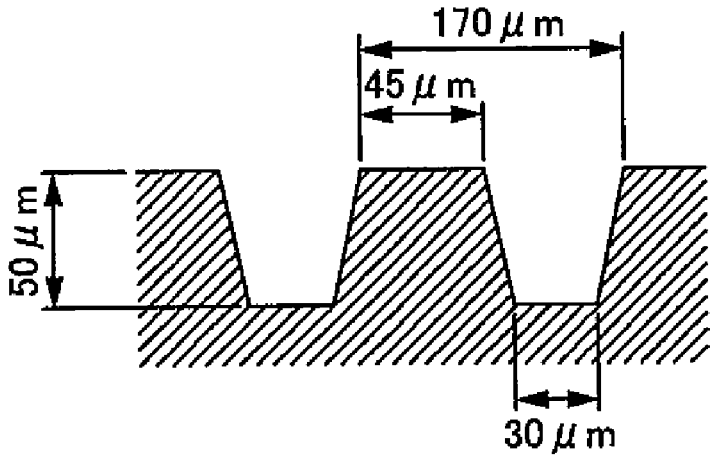
FIG. 5B
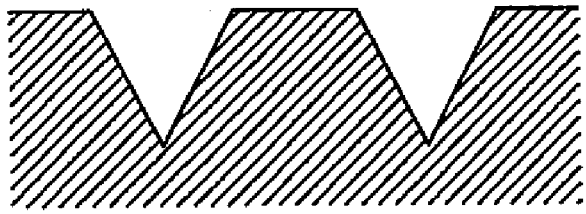
FIG. 5C
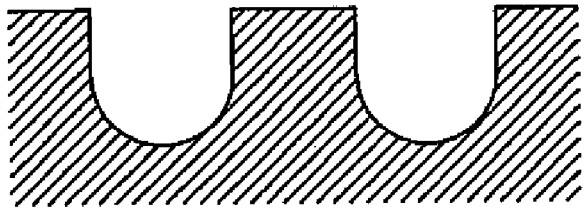
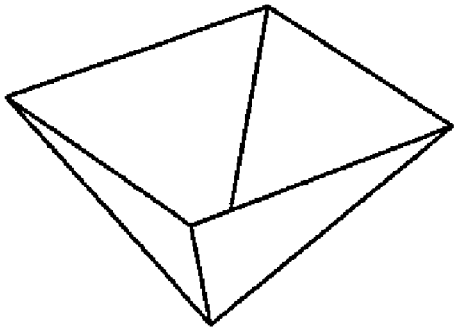
FIG. 5D
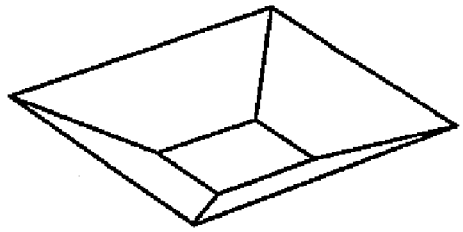
FIG. 5E

IMAGE FORMING APPARATUS, IMAGE FORMING SYSTEM, AND IMAGE FORMING METHOD

CROSS-REFERENCE TO RELATED APPLICATIONS

This application is a continuation of application Ser. No. 10/903,262 filed on Jul. 30, 2004, the entire contents of which are incorporated by reference. This application also claims benefit of priority under 35 USC 119 to Japanese Patent Application No. 2003-296755 filed Aug. 20, 2003 and Japanese Patent Application No. 2003-296756 filed Aug. 20, 2003, the entire contents of which are incorporated by reference.

BACKGROUND OF THE INVENTION

1. Field of the Invention

The present invention relates to image forming apparatuses, image forming systems, and image forming methods.

2. Description of the Related Art

There are known image forming apparatuses including a photoconductor (which is an example of a turnable image bearing body for bearing a latent image), and a developing roller (which is an example of a turnable developer bearing body for bearing liquid developer (which is also referred to simply as "developer" below), and in which the photoconductor and the developing roller are pressed in contact with each other at a predetermined press-contact position.

When such a type of image forming apparatus receives image signals etc. from an external device such as a host computer, it forms a latent image on the photoconductor. As the photoconductor turns, the latent image formed on and bore by the photoconductor reaches the press-contact position. On the other hand, as the developing roller turns, the developer bore by the developing roller is carried toward the press-contact position. The image forming apparatus develops the latent image, which has reached the press-contact position, with the developer that has been carried. (See, for example, JP 2003-76148 A).

As described above, in order to develop the latent image bore by the photoconductor, the developer bore by the developing roller is carried toward the press-contact position in accordance with the turning of the developing roller. However, if, for example, the amount of developer that passes the press-contact position is smaller than the amount of developer that is carried toward the press-contact position, then this may give rise to a situation in which the developer that could not pass the press-contact position builds up at the press-contact position. (This situation, or this built-up developer, is also referred to as "drift of liquid" below.)

If development of the latent image is carried out in a state in which the drift of liquid exists at the press-contact position, then fogging, unevenness in darkness, etc., of an image that is formed on a medium may occur, and these may cause deterioration of image quality.

SUMMARY OF THE INVENTION

The present invention has been made in view of the above and other problems, and an object thereof is to achieve an image forming apparatus, an image forming system, and an image forming method for appropriately preventing deterioration of image quality.

An aspect of the present invention is an image forming apparatus comprising: a turnable image bearing body for bearing a latent image; a turnable developer bearing body for bearing liquid developer, the developer bearing body and the image bearing body being pressed in contact with each other at a predetermined press-contact position, the developer bearing body being capable of carrying the liquid developer toward the press-contact position by turning, the image forming apparatus performing development of the latent image, which is bore by the image bearing body, with the liquid developer that has been carried toward the press-contact position; and a controller for causing the development of the latent image to start after a predetermined period of time has passed from when the turning speed of the developer bearing body and the image bearing body reached a predetermined turning speed for development at which the development is performed.

Another aspect of the present invention is an image forming apparatus comprising: a turnable image bearing body for bearing a latent image; a turnable developer bearing body for bearing liquid developer, the developer bearing body and the image bearing body being pressed in contact with each other at a predetermined press-contact position, the developer bearing body being capable of carrying the liquid developer toward the press-contact position by turning, the image forming apparatus performing development of the latent image, which is bore by the image bearing body, with the liquid developer that has been carried toward the press-contact position; and a controller for causing the developer bearing body and the image bearing body to turn, before starting of the development of the latent image, for a predetermined period of time at a turning speed that is faster than a predetermined turning speed for development at which the development is performed.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 5A through FIG. 5E show cross-sectional shapes of grooves, or shapes of recesses, provided in the surface of the developer supplying roller 550;

DETAILED DESCRIPTION OF THE INVENTION

Figure 1:
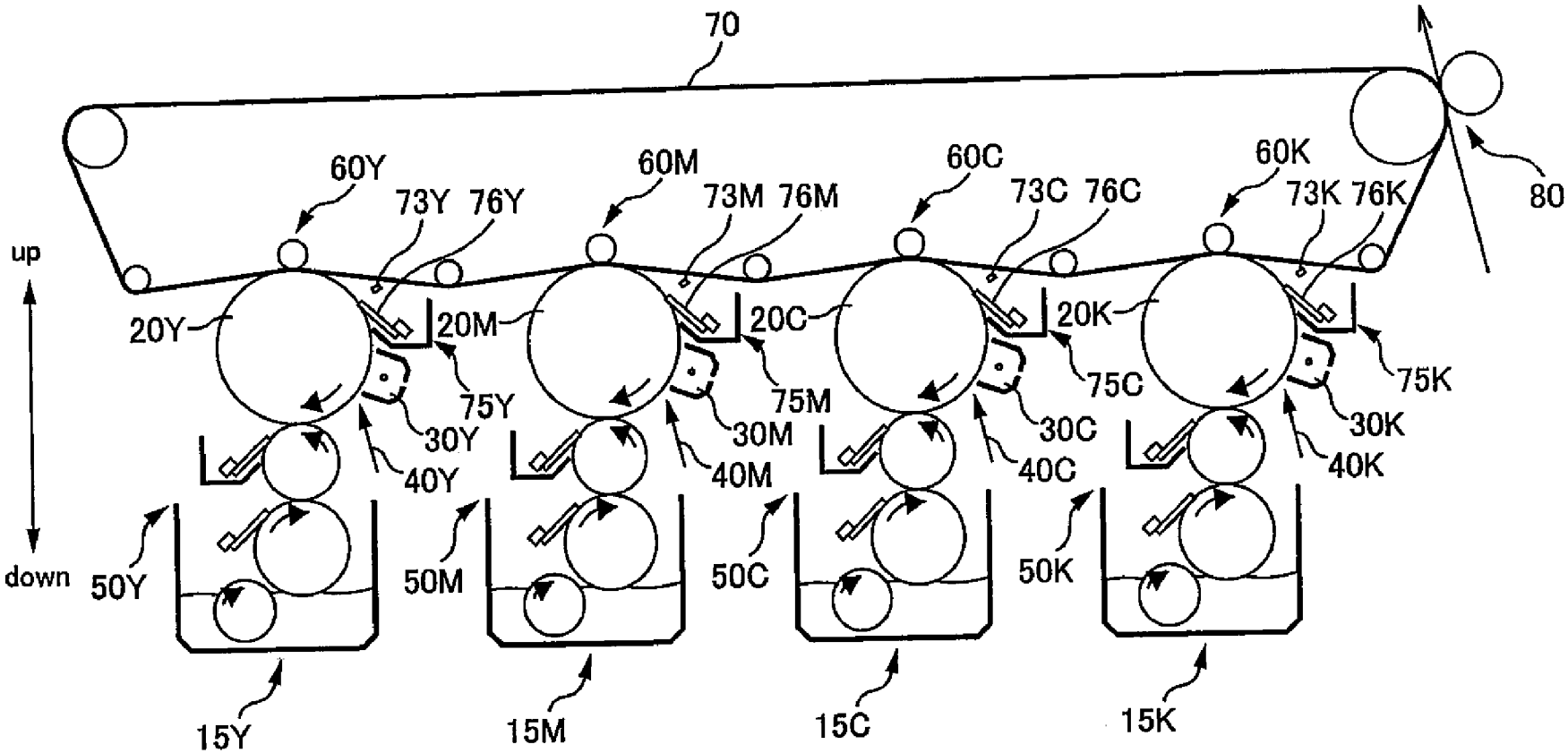
FIG. 1 is a diagram showing main structural components structuring an image forming apparatus according to an embodiment of the present invention.

At least the following matters will be made clear by the explanation in the present specification and the description of the accompanying drawings.

(1) An aspect of the present invention is an image forming apparatus comprising: a turnable image bearing body for bearing a latent image; a turnable developer bearing body for bearing liquid developer, the developer bearing body and the image bearing body being pressed in contact with each other at a predetermined press-contact position, the developer bearing body being capable of carrying the liquid developer toward the press-contact position by turning, the image forming apparatus performing development of the latent image, which is bore by the image bearing body, with the liquid developer that has been carried toward the press-contact position; and a controller for causing the development of the latent image to start after a predetermined period of time has passed from when the turning speed of the developer bearing body and the image bearing body reached a predetermined turning speed for development at which the development is performed.

By starting development of the latent image after a predetermined period of time has passed from when the turning speed of the developer bearing body and the image bearing body reached the predetermined turning speed for development, it becomes possible to appropriately prevent deterioration of image quality.

Further, the turning speed may further be increased after when the turning speed of the developer bearing body and the image bearing body reached the predetermined turning speed for development, the turning speed may then be decreased, and then the development of the latent image may be started when the turning speed of the developer bearing body and the image bearing body reaches the predetermined turning speed for development.

In this way, an advantage of being able to start appropriate development in a short amount of time from when the turning speed reached the predetermined turning speed for development is achieved.

Further, when the developer bearing body and the image bearing body turn at a turning speed that is slower than the predetermined turning speed for development, a passing amount of the liquid developer that passes the press-contact position may be smaller than a carrying amount of the liquid developer that is carried toward the press-contact position.

With the present invention, it becomes possible to appropriately prevent deterioration of image quality by starting development of the latent image, in consideration of the drift of liquid that is caused in the above-mentioned case.

Further, the developer bearing body may be a developing roller.

By starting development of the latent image after a predetermined period of time has passed from when the turning speed of the developing roller and the image bearing body reached the predetermined turning speed for development, it becomes possible to appropriately prevent deterioration of image quality.

Further, the developing roller and the image bearing body may be rotatable.

In such a case, the latent image bore by the image bearing body can be efficiently developed with the liquid developer bore by the developing roller.

Further, the developing roller may have an elastic section; and the image bearing body and the elastic section may be pressed in contact with each other.

With the present invention, it becomes possible to appropriately prevent deterioration of image quality by starting development of the latent image, in consideration of the drift of liquid that exists around the press-contact position where the image bearing body and the elastic section are pressed in contact with each other.

Further, the rotating speed of the developing roller may be equal to the rotating speed of the image bearing body.

In this way, rotation control becomes easy.

Further, the rotating direction of the developing roller may be opposite from the rotating direction of the image bearing body.

In this way, it becomes possible to prevent an excessive rotational resistance from occurring at the press-contact sections of both members.

Further, the liquid developer may be a non-volatile liquid developer that is non-volatile at room temperature.

In such a case, it is more effective in terms of cost reduction etc. to adopt the measure according to the present invention as the countermeasure for preventing deterioration of image quality caused by the drift of liquid.

It is also possible to achieve an image forming apparatus comprising: a turnable image bearing body for bearing a latent image; a turnable developer bearing body for bearing liquid developer, the developer bearing body and the image bearing body being pressed in contact with each other at a predetermined press-contact position, the developer bearing body being capable of carrying the liquid developer toward the press-contact position by turning, the image forming apparatus performing development of the latent image, which is bore by the image bearing body, with the liquid developer that has been carried toward the press-contact position; and a controller for causing the development of the latent image to start after a predetermined period of time has passed from when the turning speed of the developer bearing body and the image bearing body reached a predetermined turning speed for development at which the development is performed, wherein: the turning speed is further increased after when the turning speed of the developer bearing body and the image bearing body reached the predetermined turning speed for development, the turning speed is then decreased, and then the development of the latent image is started when the turning speed of the developer bearing body and the image bearing body reaches the predetermined turning speed for development; when the developer bearing body and the image bearing body turn at a turning speed that is slower than the predetermined turning speed for development, a passing amount of the liquid developer that passes the press-contact position is smaller than a carrying amount of the liquid developer that is carried toward the press-contact position; the developer bearing body is a developing roller; the developing roller and the image bearing body are rotatable; the developing roller has an elastic section; the image bearing body and the elastic section are pressed in contact with each other; the rotating speed of the developing roller is equal to the rotating speed of the image bearing body; the rotating direction of the developing roller is opposite from the rotating direction of the image bearing body; and the liquid developer is a non-volatile liquid developer that is non-volatile at room temperature.

It is also possible to achieve an image forming system comprising: a computer; and an image forming apparatus that is connectable to the computer and that includes: a turnable image bearing body for bearing a latent image; a turnable developer bearing body for bearing liquid developer, the developer bearing body and the image bearing body being pressed in contact with each other at a predetermined press-contact position, the developer bearing body being capable of carrying the liquid developer toward the press-contact position by turning, the image forming apparatus performing development of the latent image, which is bore by the image bearing body, with the liquid developer that has been carried toward the press-contact position; and a controller for causing the development of the latent image to start after a predetermined period of time has passed from when the turning speed of the developer bearing body and the image bearing body reached a predetermined turning speed for development at which the development is performed.

As an overall system, the image forming system that is achieved in this way becomes superior to conventional systems.

It is also possible to achieve an image forming method comprising the steps of: pressing a turnable developer bearing body for bearing liquid developer and a turnable image bearing body for bearing a latent image in contact with each other at a predetermined press-contact position; causing the developer bearing body to turn to carry the liquid developer toward the press-contact position; and starting development of the latent image, which is bore by the image bearing body, with the liquid developer that has been carried toward the press-contact position after a predetermined period of time has passed from when the turning speed of the developer bearing body and the image bearing body reached a predetermined turning speed for development at which the development is performed.

According to this image forming method, it becomes possible to appropriately prevent deterioration of image quality.

(2) Another aspect of the present invention is an image forming apparatus comprising: a turnable image bearing body for bearing a latent image; a turnable developer bearing body for bearing liquid developer, the developer bearing body and the image bearing body being pressed in contact with each other at a predetermined press-contact position, the developer bearing body being capable of carrying the liquid developer toward the press-contact position by turning, the image forming apparatus performing development of the latent image, which is bore by the image bearing body, with the liquid developer that has been carried toward the press-contact position; and a controller for causing the developer bearing body and the image bearing body to turn, before starting of the development of the latent image, for a predetermined period of time at a turning speed that is faster than a predetermined turning speed for development at which the development is performed.

By turning, before starting of the development of the latent image, the developer bearing body and the image bearing body for a predetermined period of time at a turning speed that is faster than the predetermined turning speed for development, it becomes possible to appropriately prevent deterioration of image quality.

Further, when the developer bearing body and the image bearing body turn at a turning speed that is slower than the predetermined turning speed for development, a passing amount of the liquid developer that passes the press-contact position may be smaller than a carrying amount of the liquid developer that is carried toward the press-contact position.

With the present invention, it becomes possible to appropriately prevent deterioration of image quality by turning, before starting of the development of the latent image, the developer bearing body and the image bearing body for a predetermined period of time at a turning speed that is faster than the predetermined turning speed for development, in consideration of the drift of liquid that is caused in the above-mentioned case.

Further, the developer bearing body may be a developing roller.

By turning, before starting of the development of the latent image, the developing roller and the image bearing body for a predetermined period of time at a turning speed that is faster than the predetermined turning speed for development, it becomes possible to appropriately prevent deterioration of image quality.

Further, the image bearing body for bearing the latent image and the developing roller for bearing the liquid developer may be rotatable; the developing roller may be capable of carrying the liquid developer toward the press-contact position by rotating, and the image forming apparatus may perform the development of the latent image, which is bore by the image bearing body, with the liquid developer that has been carried toward the press-contact position; and the controller may cause the developing roller and the image bearing body to rotate, before starting of the development of the latent image, for a predetermined period of time at a rotating speed that is faster than a predetermined rotating speed for development at which the development is performed.

In such a case, the latent image bore by the image bearing body can be efficiently developed with the liquid developer bore by the developing roller.

Further, the developing roller may have an elastic section; and the image bearing body and the elastic section may be pressed in contact with each other.

With the present invention, it becomes possible to appropriately prevent deterioration of image quality by turning, before starting of the development of the latent image, the developer bearing body and the image bearing body for a predetermined period of time at a turning speed that is faster than the predetermined turning speed for development, in consideration of the drift of liquid that exists around the press-contact position where the image bearing body and the elastic section are pressed in contact with each other.

Further, the rotating speed of the developing roller may be equal to the rotating speed of the image bearing body.

In this way rotation control becomes easy.

Further, the rotating direction of the developing roller may be opposite from the rotating direction of the image bearing body.

In this way, it becomes possible to prevent an excessive rotational resistance from occurring at the press-contact sections of both members.

Further, the liquid developer may be a non-volatile liquid developer that is non-volatile at room temperature.

In such a case, it is more effective in terms of cost reduction etc. to adopt the measure according to the present invention as the countermeasure for preventing deterioration of image quality caused by the drift of liquid.

It is also possible to achieve an image forming apparatus comprising: a rotatable image bearing body for bearing a latent image; a rotatable developer bearing body for bearing liquid developer, the developer bearing body and the image bearing body being pressed in contact with each other at a predetermined press-contact position, the developer bearing body being capable of carrying the liquid developer toward the press-contact position by rotating, the image forming apparatus performing development of the latent image, which is bore by the image bearing body, with the liquid developer that has been carried toward the press-contact position; and a controller for causing the developer bearing body and the image bearing body to rotate, before starting of the development of the latent image, for a predetermined period of time at a rotating speed that is faster than a predetermined rotating speed for development at which the development is performed, wherein: when the developer bearing body and the image bearing body rotate at a rotating speed that is slower than the predetermined rotating speed for -development, a passing amount of the liquid developer that passes the press-contact position is smaller than a carrying amount of the liquid developer that is carried toward the press-contact position; the developer bearing body is a developing roller; the developing roller has an elastic section; the image bearing body and the elastic section are pressed in contact with each other; the rotating speed of the developing roller is equal to the rotating speed of the image bearing body; the rotating direction of the developing roller is opposite from the rotating direction of the image bearing body; and the liquid developer is a non-volatile liquid developer that is non-volatile at room temperature.

It is also possible to achieve an image forming system comprising: a computer; and an image forming apparatus that is connectable to the computer and that includes: a turnable image bearing body for bearing a latent image; a turnable developer bearing body for bearing liquid developer, the developer bearing body and the image bearing body being pressed in contact with each other at a predetermined press-contact position, the developer bearing body being capable of carrying the liquid developer toward the press-contact position by turning, the image forming apparatus performing development of the latent image, which is bore by the image bearing body, with the liquid developer that has been carried toward the press-contact position; and a controller for causing the developer bearing body and the image bearing body to turn, before starting of the development of the latent image, for a predetermined period of time at a turning speed that is faster than a predetermined turning speed for development at which the development is performed.

As an overall system, the image forming system that is achieved in this way becomes superior to conventional systems.

It is also possible to achieve an image forming method comprising the steps of: pressing a turnable developer bearing body for bearing liquid developer and a turnable image bearing body for bearing a latent image in contact with each other at a predetermined press-contact position; causing the developer bearing body to turn to carry the liquid developer toward the press-contact position; and causing the developer bearing body and the image bearing body to turn, before starting development of the latent image with the liquid developer that has been carried toward the press-contact position, for a predetermined period of time at a turning speed that is faster than a predetermined turning speed for development at which the development is performed.

According to this image forming method, it becomes possible to appropriately prevent deterioration of image quality.

It should be noted that the term "turn (turning; turnable)" is used herein to refer to "a circular movement of more than 0° in both the clockwise and counterclockwise directions, or in either the clockwise or counterclockwise direction". The term "turning speed" is used herein to refer to "a speed of something when it is turning". The term "rotate (rotating; rotatable)" is used herein to refer to "a circular movement of more than 0° in either the clockwise or counterclockwise direction". The term "rotating speed" is used herein to refer to "a speed of something when it is rotating".

Overall Configuration Example of Image Forming Apparatus

Next, with reference to FIG. 1, an outline of a laser beam printer 10 (referred to also as "printer 10" below), which is an example of an image forming apparatus, is described. FIG. 1 is a diagram showing main structural components structuring the printer 10. It should be noted that in FIG. 1, the vertical direction is shown by the arrow, and, for example, developing units 50Y, 50M, 50C, and 50K are arranged in the lower section of the printer 10, and an intermediate transferring body 70 is arranged in the upper section of the printer 10.

As shown in FIG. 1, the printer 10 according to the present embodiment includes four developing sections 15Y, 15M, 15C, and 15K, an intermediate transferring body 70, and a second transferring unit 80. The printer 10 further includes a not-shown fusing unit, a displaying unit constructed of a liquid-crystal panel and serving as means for making notifications to users, and a control unit 100 (see FIG. 2) for controlling these units etc. and managing the operations as a printer.

Each of the developing sections 15Y, 15M, 15C, and 15K has the function of developing latent images with yellow (Y) developer, magenta (M) developer, cyan (C) developer, and black (K) developer, respectively. Since the structure of the developing sections 15Y, 15M, 15C, and 15K is substantially the same, only the developing section 15Y is described in detail below.

As shown in FIG. 1, the developing section 15Y includes a charging unit 30Y, an exposing unit 40Y, a developing unit 50Y which serves as an example of a developing device, a first transferring unit 60Y, a static eliminating unit 73Y, and a photoconductor cleaning unit 75Y, all of which being arranged in the direction of rotation of a photoconductor 20Y which serves as an example of an image bearing body.

The photoconductor 20Y has a cylindrical base and a photoconductive layer formed on the outer peripheral surface of the base, and it is rotatable about its central axis. In the present embodiment, the photoconductor 20Y rotates clockwise, as shown by the arrow in FIG. 1.

The charging unit 30Y is a device for charging the photoconductor 20Y. The exposing unit 40Y is a device for forming a latent image on the charged photoconductor 20Y by radiating a laser beam thereon. The exposing unit 40Y has, for example, a semiconductor laser, a polygon mirror, and an F-θ lens, and radiates a modulated laser beam onto the charged photoconductor 20Y according to image signals having been input from a not-shown host computer such as a personal computer or a word processor.

The developing unit 50Y is a device for developing the latent image formed on the photoconductor 20Y using the yellow (Y) developer. Details on the developing unit 50Y will be described further below.

The first transferring unit 60Y is a device for transferring, onto the intermediate transferring body 70, the yellow developer image formed on the photoconductor 20Y. When developer of four colors are successively transferred in a superposed manner by the respective first transferring units 60Y, 60M, 60C, and 60K, a full-color developer image is formed on the intermediate transferring body 70.

The intermediate transferring body 70 is an endless belt that is wound around a plurality of supporting rollers, and is driven to rotate while abutting against the photoconductors 20Y, 20M, 20C, and 20K.

The second transferring unit 80 is a device for transferring the single-color developer image, or the full-color developer image, formed on the intermediate transferring body 70 onto a medium such as paper, film, and cloth.

The fusing unit, which is not shown, is a device for fusing the single-color developer image or the full-color developer image, which has been transferred to the medium, onto the medium such as paper to make it into a permanent image.

The static eliminating unit 73Y is a device for eliminating the electric charge remaining on the photoconductor 20Y after the developer image has been transferred onto the intermediate transferring body 70 by the first transferring unit 60Y.

The photoconductor cleaning unit 75Y is a device that has a photoconductor cleaning blade 76Y made of rubber and made to abut against the surface of the photoconductor 20Y, and that is for removing the developer remaining on the photoconductor 20Y by scraping it off with the photoconductor cleaning blade 76Y after the developer image has been transferred onto the intermediate transferring body 70 by the first transferring unit 60Y.

Figure 2:
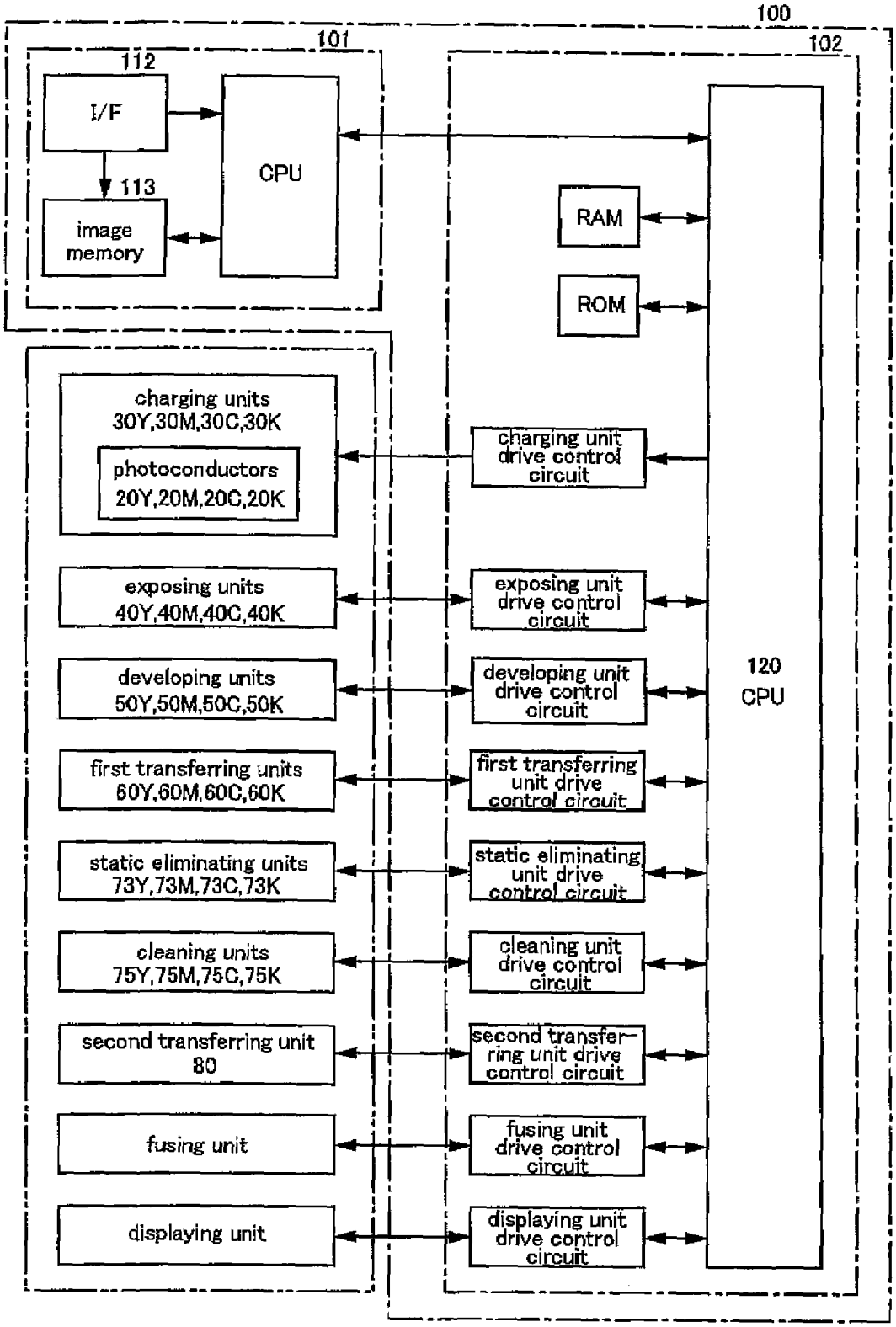
FIG. 2 is a block diagram showing a control unit of the image forming apparatus of FIG. 1.

The control unit 100 includes a main controller 101 and a unit controller 102 as shown in FIG. 2. Image signals and control signals are input to the main controller 101, and according to instructions based on these image signals and control signals, the unit controller 102 controls each of the above-mentioned units etc. to form an image.

Overview of Control Unit

Next, with reference to FIG. 2, the configuration of the control unit 100 will be described. The main controller 101 of the control unit 100 is connected to a host computer via an interface 112, and has an image memory 113 for storing image signals that have been input from the host computer. The unit controller 102 is electrically connected to each of the units in the apparatus body (that is, to the charging units 30Y, 30M, 30C, and 30K, the exposing units 40Y, 40M, 40C, and 40K, the developing units 50Y, 50M, 50C, and 50K, the first transferring units 60Y, 60M, 60C, and 60K, the static eliminating units 73Y, 73M, 73C, and 73K, the photoconductor cleaning units 75Y, 75M, 75C, and 75K, the second transferring unit 80, the fusing unit, and the displaying unit). The unit controller 102, controls each of these units according to signals received from the main controller 101 while detecting the state of each of these units by receiving signals from sensors provided in each unit.

Configuration Example of Developing Unit

Figure 3:
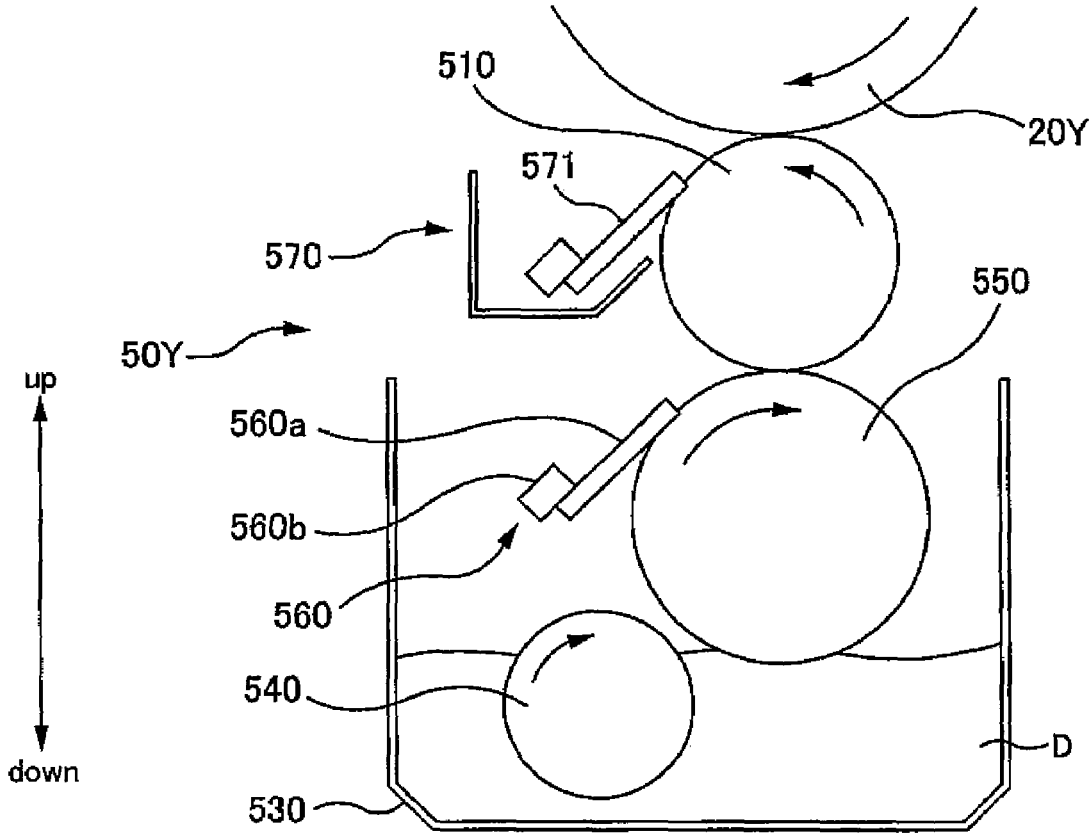
FIG. 3 is a section view showing main structural components of a developing unit.
Figure 4:
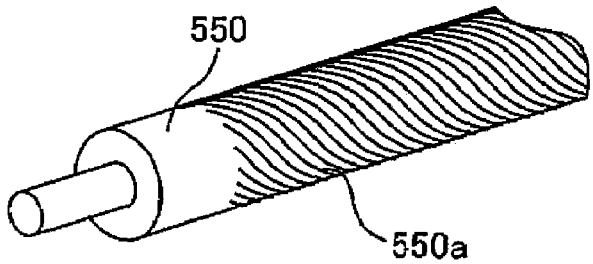
FIG. 4 is a perspective view conceptually showing the surface of a developer supplying roller 550.

Next, using FIG. 3 through FIG. 5, an example of a configuration of a developing unit will be described. FIG. 3 is a section view showing main structural components of a developing unit. FIG. 4 is a perspective view conceptually showing the surface of a developer supplying roller 550. FIG. 5A through FIG. 5E show the cross-sectional shapes of grooves, or the shapes of recesses, provided in the surface of the developer supplying roller 550. It should be noted that in FIG. 3, the arrow indicates the vertical direction as in FIG. 1, and, for example, the developing roller 510 is positioned above the developer drawing roller 540.

The printer 10 has, as developing units, a black developing unit 50K containing black (K) developer, a magenta developing unit 50M containing magenta (M) developer, a cyan developing unit 50C containing cyan (C) developer, and a yellow developing unit 50Y containing yellow (Y) developer. Since the structure of each developing unit is substantially the same, only the yellow developing unit 50Y is described in detail below.

The yellow developing unit 50Y has a developing roller 510 serving as an example of a developer bearing body, a developer containing section 530, a developer drawing roller 540, a developer supplying roller 550, a restriction blade 560, and a developing-roller cleaning unit 570.

The developer containing section 530 contains developer D which is for developing a latent image formed on the photoconductor 20Y. The type of developer D contained in the developer containing section 530 is a high-concentration, high-viscosity, non-volatile liquid developer D that is non-volatile at room temperature, and is not the general, conventional volatile liquid developer which employs Isopar (trademark: Exxon Mobil Corporation) as a carrier, has low concentration (approximately 1 to 2 wt %) and low viscosity, and is volatile at room temperature. More specifically, the liquid developer D according to the present embodiment has a high viscosity (approximately 100 to 10000 mPa·s) and is made by dispersing, at a high concentration (approximately 5 to 40 wt %), toner particles having an average particle size of approximately 0.1 to 5 μm and being made, for example, of resin or pigment into a non-volatile, insulating carrier liquid such as silicone oil.

The developer drawing roller 540 draws up the developer D, which is contained in the developer containing section 530, and carries it to the developer supplying roller 550. The lower section of the developer drawing roller 540 is immersed in the developer D contained in the developer containing section 530. The developer drawing roller 540 is separated from the developer supplying roller 550 at a distance of approximately 1 mm.

The developer drawing roller 540 is rotatable about its central axis. The central axis of the roller 540 is below the central axis of rotation of the developer supplying roller 550. Further, the developer drawing roller 540 rotates in the same direction (clockwise in FIG. 3) as the rotating direction of the developer supplying roller 550 (clockwise in FIG. 3). It should be noted that the developer drawing roller 540 not only has the function of drawing up the developer D contained in the developer containing section 530 and carrying it to the developer supplying roller 550, but also has the function of stirring the developer D in order to maintain the developer D in a suitable state.

The developer supplying roller 550 supplies the developer D, which has been carried from the developer containing section 530 by the developer drawing roller 540, to the developing roller 510. The developer supplying roller is made by providing helical grooves 550a at even pitches in the surface of a roller made of metal such as iron as shown in FIG. 4, and providing a nickel plating thereon. The diameter of the developer supplying roller 550 is approximately 25 mm. The developer supplying roller 550 of the present embodiment is provided with grooves 550*a* having a trapezoidal cross section as shown in FIG. 5A. It is instead possible to provide a multitude of recesses having a shape as shown, for example, in FIG. 5D or FIG. 5E in the developer supplying roller 550. Further, the grooves 550*a* do not have to have a shape as shown in FIG.

5A, and it is instead possible, for example, to provide grooves having a cross section in the shape of an inverted delta as shown in FIG. 5B, or grooves having a semicircular cross section as shown in FIG. 5C. It should be noted that the size of the grooves of the developer supplying roller 550 of the present embodiment is as shown in FIG. 5A: the groove pitch is approximately 170 μm, the width of the crest is approximately 45 μm, the width of the trough is approximately 30 μm, and the depth of the groove is approximately 50 μm.

Further, the surface of the developer supplying roller 550 is pressed in contact with a layer of an elastic body of the developing roller 510 (which is described later) in order to appropriately transfer the developer D on the developer supplying roller 550 to the developing roller 510. The developer supplying roller 550 is rotatable about its central axis, and the central axis thereof is below the central axis of rotation of the developing roller 510. Further, the developer supplying roller 550 rotates in the direction (clockwise in FIG. 3) opposite from the rotating direction of the developing roller 510 (counterclockwise in FIG. 3).

The restriction blade 560 abuts against the surface of the developer supplying roller 550 to restrict the amount of developer D on the developer supplying roller 550. More specifically, the restriction blade 560 serves as to scrape off any excessive developer on the developer supplying roller 550 to measure the developer D on the developer supplying roller 550, which is to be supplied to the developing roller 510.

The restriction blade 560 has a rubber section 560*a* that abuts against the developer supplying roller 550, and a rubber-supporting section 560*b* that supports the rubber section 560*a*. The rubber section 560*a* is made of urethane rubber, and the rubber hardness is approximately 62 degrees in JIS (Japanese Industrial Standards) A scale. The rubber-supporting section 560*b* is a sheet of metal such as iron.

The restriction blade 560 abuts against the surface of the developer supplying roller 550 with its edge, and thus, carries out a so-called "edge restriction". Further, as shown in FIG. 3, the restriction blade 560 is arranged such that its tip end faces toward the downstream side of the rotating direction of the developer supplying roller 550, and thus, carries out a so-called "trailing restriction".

The developing roller 510 bears the developer D and carries it to a developing position, which is in opposition to the photoconductor 20Y, in order to develop a latent image bore by the photoconductor 20Y with the developer D. The developing roller 510 has a layer of an elastic body, which serves as an example of an elastic section having conductivity, on the outer circumferential section of its inner core made of metal such as iron. The diameter of the developing roller 510 is approximately 20 mm. The layer of the elastic body has a two-layer structure: urethane rubber with a thickness of approximately 5 mm and a rubber hardness of approximately 30 degrees in JIS-A is provided as the inner layer; and urethane rubber with a thickness of approximately 30 μm and a rubber hardness of approximately 85 degrees in JIS-A is provided as the surface layer (outer layer). The developing roller 510 is pressed in contact with the developer supplying roller 550 and the photoconductor 20Y in an elastically-deformed state, the above-mentioned surface layer serving as a press-contact section.

The developing roller 510 is rotatable about its central axis, and the central axis thereof is below the central axis of rotation of the photoconductor 20Y. Further, the developing roller 510 rotates in the direction (counterclockwise in FIG. 3) opposite from the rotating direction of the photoconductor 20Y (clockwise in FIG. 3), and the roller 510 and the photoconductor 20Y are controlled to rotate at the same rotating speed. It should be noted that an electric field is generated between the developing roller 510 and the photoconductor 20Y when the latent image formed on the photoconductor 20Y is being developed.

The developing-roller cleaning unit 570 is a device that has a developing-roller cleaning blade 571, which is made of rubber and which is made to abut against the surface of the developing roller 510, and is for scraping off and removing the developer D remaining on the developing roller 510 with the developing-roller cleaning blade 571 after development has been carried out at the developing position.

First Example of Operations of the Printer 10

A first example of image-forming operations of the printer 10, which is structured as above, is described below.

When image signals and control signals are input from the not-shown host computer to the main controller 101 of the printer 10 through the interface (I/F) 112, the photoconductors 20Y, 20M, 20C, and 20K and the developing rollers etc. provided in the respective developing units 50Y, 50M, 50C, and 50K start rotating under the control of the unit controller 102 according to the instructions from the main controller 101. While being rotated, the photoconductors 20Y, 20M, 20C, and 20K are successively charged, respectively, by the charging units 30Y, 30M, 30C, and 30K at respective charging positions.

With the rotation of the photoconductors 20Y, 20M, 20C, and 20K, the charged area of each of the photoconductors 20Y, 20M, 20C, and 20K reaches an exposing position. A latent image that corresponds to the image information for yellow Y, magenta M, cyan C, and black K is formed, respectively, in the charged area of the respective photoconductors by the respective exposing units 40Y, 40M, 40C, and 40K.

With the rotation of the photoconductors 20Y, 20M, 20C, and 20K, the latent image formed on the respective photoconductors 20Y, 20M, 20C, and 20K reaches the developing position, and is developed, respectively, by the respective developing units 50Y, 50M, 50C, and 50K. Thus, a developer image is formed on each of the photoconductors 20Y, 20M, 20C, and 20K.

The latent-image developing operation of the developing units 50Y, 50M, 50C, and 50K is now described in detail. It should be noted that, as described above, although the printer 10 has, as developing units, a black developing unit 50K, a magenta developing unit 50M, a cyan developing unit 50C, and a yellow developing unit 50Y, only the yellow developing unit 50Y is described in detail below because the developing operation of each developing unit is substantially the same.

In the yellow developing unit 50Y, the developer drawing roller 540 rotates about its central axis to draw up the developer D contained in the developer containing section 530 and carry it to the developer supplying roller 550.

With the rotation of the developer supplying roller 550, the developer D that has been carried to the developer supplying roller 550 reaches an abutting position where the restriction blade 560 abuts against the roller 550. As the developer D on the roller 550 passes the abutting position, an excessive portion of the developer D is scraped off by the restriction blade 560, and thus, the amount of developer D to be supplied to the developing roller 510 is measured. That is, since the developer supplying roller 550 is provided with the grooves 550*a* as described above, the restriction blade 560, which abuts against the developer supplying roller 550, scrapes off the developer D on the developer supplying roller 550 except for the developer D that is retained in the grooves 550*a*. The dimension of the grooves 550*a* is determined in advance such that the amount of developer D to be supplied to the developing roller 510 becomes appropriate, so that when the restriction blade 560 scrapes off the developer D on the developer supplying roller 550, an appropriate amount of developer D, which has been suitably measured by means of the grooves 550*a*, will remain in the grooves 550*a*.

With further rotation of the developer supplying roller 550, the developer D retained in the grooves 550*a* of the developer supplying roller 550 reaches a press-contact position where the roller 550 is pressed in contact with the developing roller 510. The developer D that has reached the press-contact position is transferred from the developer supplying roller 550 onto the developing roller 510 by the action of a pressure that is created as a result of the developer supplying roller 550 and the developing roller 510 being pressed in contact with each other, thereby forming a thin layer of developer D on the developing roller 510.

The thin layer of developer D formed on the developing roller 510 in this way is carried, by the rotation of the developing roller 510, toward a press-contact position (i.e., the developing position in opposition to the photoconductor 20Y) where the roller 510 abuts against the photoconductor 20Y. The thin layer of developer D carried toward the press-contact position is used, at the press-contact position, for development of the latent image formed on the photoconductor 20Y under an electric field of a predetermined intensity, and thus, a developer image is formed on the photoconductor 20Y.

It should be noted that although the photoconductor 20Y and the developing roller 510 start to rotate when image signals etc. from the host computer are input to the printer 10 as described above, the printer 10 starts development of the latent image after it increases the rotating speed of the photoconductor 20Y and the developing roller 510 so that the rotating speed reaches a predetermined value (i.e., a "predetermined rotating speed for development"). Further, in the present first example, the printer 10 does not start development right after the rotating speed reaches the rotating speed for development, but starts development after a predetermined period of time has passed from when the rotating speed reached the rotating speed for development. In the present example, the rotating speed of the photoconductor 20Y and the developing roller 510 is maintained at the rotating speed for development during the above-mentioned predetermined period of time, that is, during the period from when the rotating speed of the photoconductor 20Y and the developing roller 510 reached the rotating speed for development until when development is started.

Further, with further rotation of the developing roller 510, the developer D on the developing roller 510 that has passed the developing position reaches an abutting position where the developing-roller cleaning blade 571 abuts against the roller 510. When passing the abutting position, the developer D adhering to the surface of the developing roller 510 is scraped off by the developing-roller cleaning blade 571, and the scraped-off developer D is collected in a remaining-developer collector of the developing-roller cleaning unit 570.

With the rotation of the photoconductors 20Y, 20M, 20C, and 20K, the developer images formed on the respective photoconductors 20Y, 20M, 20C, and 20K reach their respective first transferring positions, and are transferred onto the intermediate transferring body 70 by the respective first transferring units 60Y, 60M, 60C, and 60K. At this time, a first transferring voltage, which is in an opposite polarity to the polarity to which the developer is charged, is applied to the first transferring units 60Y, 60M, 60C, and 60K. As a result, the developer images in four colors formed respectively on each photoconductor 20Y, 20M, 20C, and 20K are transferred onto the intermediate transferring body 70 in a superposed manner, thereby forming a full-color developer image on the intermediate transferring body 70.

With the rotation of the intermediate transferring body 70, the full-color developer image formed on the intermediate transferring body 70 reaches a second transferring position, and is transferred onto a medium by the second transferring unit 80. It should be noted that the medium is carried from a paper supply tray, which is not shown in the figure, to the second transferring unit 80 by means of various rollers. (The arrow in FIG. 1 indicates the direction in which the medium is carried.) During transferring operations, a second transferring voltage is applied to the second transferring unit 80 and also the unit 80 is pressed against the intermediate transferring body 70.

The full-color developer image transferred onto the medium is heated and pressurized by the fusing unit and fused to the medium.

On the other hand, after the photoconductors 20Y, 20M, 20C, and 20K have passed their respective first transferring positions, the electric charge is eliminated by the respective static eliminating units 73Y, 73M, 73C, and 73K, and the developer adhering to the surface of each photoconductor 20Y, 20M, 20C, and 20K is scraped off by the respective photoconductor cleaning blades 76Y, 76M, 76C, and 76K that are supported on the respective photoconductor cleaning units 75Y, 75M, 75C, and 75K. In this way, the photoconductor 20 is prepared for charging for the next latent image to be formed. The scraped-off developer is collected in a remaining-developer collector of the respective photoconductor cleaning units 75Y, 75M, 75C, and 75K.

After confirming that there are no more image signals etc. from the host computer, the printer 10 decreases the rotating speed of the photoconductor, the developing roller, etc., to bring the photoconductor, the developing roller, etc., to a stop. The printer 10 then enters a standby state and waits for the next image formation.

First Example of Mechanism According to which Drift of Liquid is Created

As described in the section of the "Description of the Related Art", there are situations in which a drift of liquid is created at the press-contact position when the developer bore by the developing roller is carried toward the press-contact position by the rotation of the developing roller. Below, the mechanism according to which this drift of liquid is created is described with reference to FIG. 6 through FIG. 8.

Figure 6:
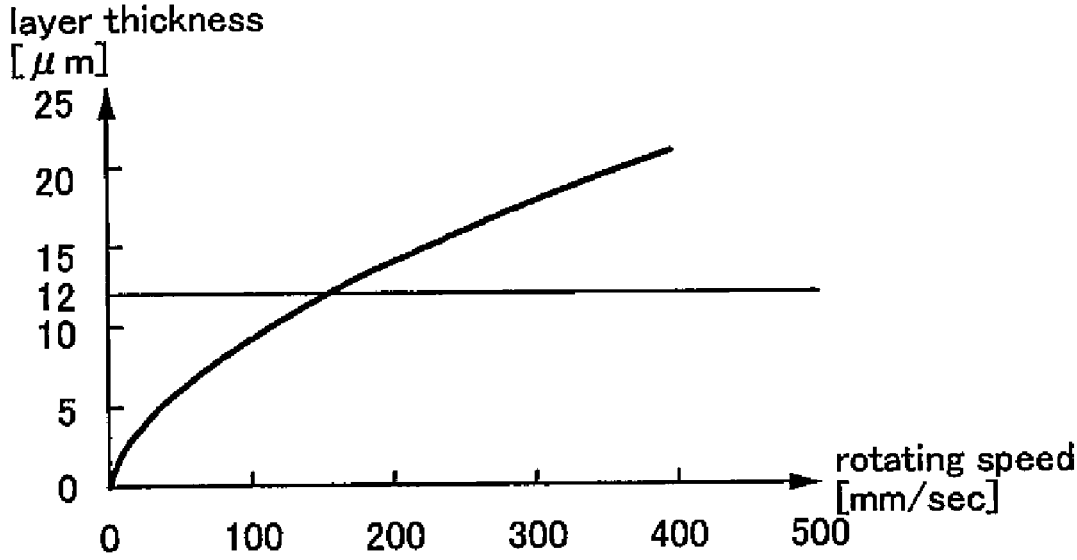
FIG. 6 is a diagram showing a first example of a relationship between the rotating speed of a photoconductor and a developing roller, and the amount of developer carried toward a press-contact position or the amount of developer that passes the press-contact position.

First, attention is paid to FIG. 6. FIG. 6 is a diagram showing a relationship between the rotating speed of the photoconductor and the developing roller (which is also referred to simply as "rotating speed" below), and the amount of developer carried toward the above-mentioned press-contact position (which is also referred to simply as "carrying amount" below) or the amount of developer that can pass the press-contact position (which is also referred to simply as "passing amount" below). In this figure, the horizontal axis indicates the rotating speed, and the vertical axis indicates the layer thickness (i.e., the thickness of the thin layer of developer on the developing roller) which indicates either the amount of developer carried toward the press-contact position or the amount of developer that passes the press-contact position. One straight line and one curved line are shown in the figure: the former indicates a relationship between the rotating speed and the carrying amount, and the latter indicates a relationship between the rotating speed and the passing amount.

Taking FIG. 6 into consideration, it is found that the thickness of the layer of developer carried toward the press-contact position (i.e., the carrying amount) takes a constant value regardless of the rotating speed, because the carrying amount is not dependent on the rotating speed. In the present example, the constant value is approximately 12 μm. On the other hand, as shown in FIG. 6, the thickness of the layer of developer that can pass the press-contact position (i.e., the passing amount) becomes smaller as the rotating speed becomes slower, as known from the relational equation according to the elasto-hydrodynamic lubrication theory described in Equation 5 of above-mentioned JP 2003-76148 A.

Figure 7:
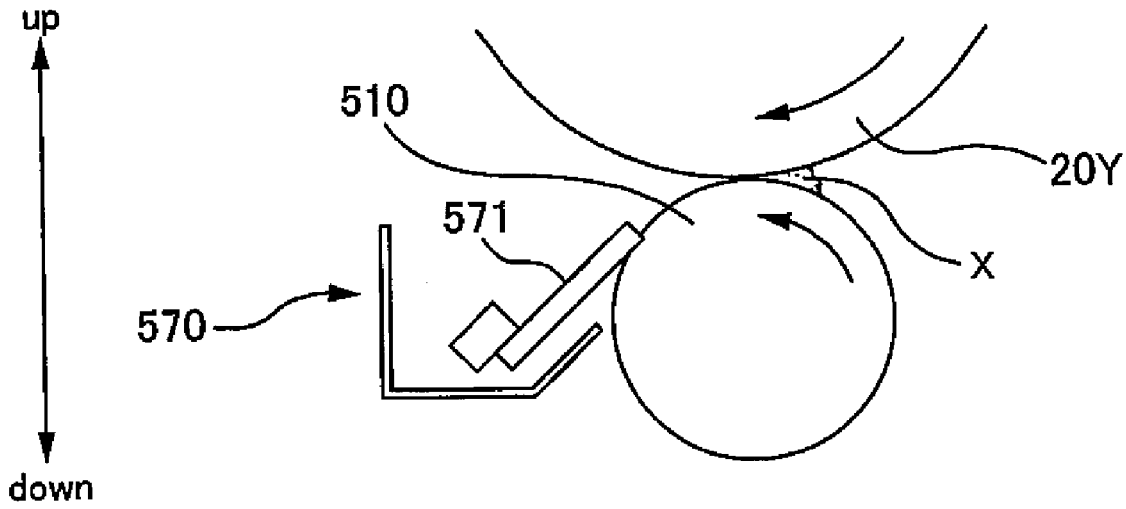
FIG. 7 is a conceptual diagram showing how a drift of liquid is created at the press-contact position according to the first example.

According to these relationships, the following can be derived. That is, when the thickness of the layer of developer that passes the press-contact position (i.e., the passing amount) is smaller than the thickness of the layer of developer carried toward the press-contact position (i.e., the carrying amount) due to the rotating speed being slow, a situation is caused in which some of the developer cannot pass the press-contact position even though it has been carried thereto. As indicated by the mark "X" in FIG. 7, the developer that could not pass the press-contact position builds up around the press-contact position (particularly around the entrance), and a drift of liquid is created. It should be noted that FIG. 7 is a conceptual diagram showing how a drift of liquid is created at the press-contact position.

Figure 8:
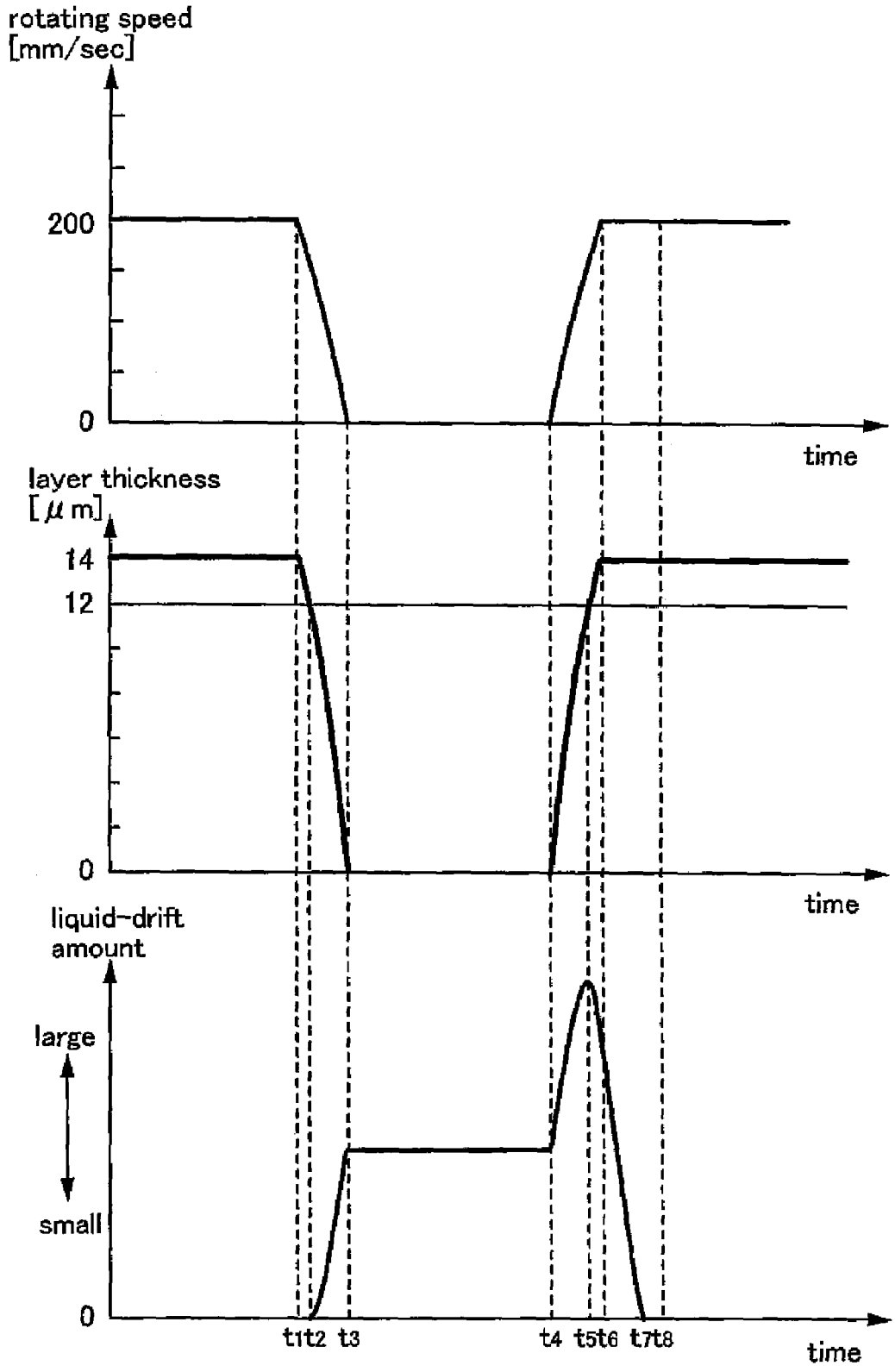
FIG. 8 shows a time chart illustrating the change over time of the rotating speed of the photoconductor and the developing roller, and the amount of developer carried toward the press-contact position or the amount of developer that passes the press-contact position, and the build-up amount of the drift of liquid according to the first example.

Next, the timing at which the above-described situation occurs during the operations of the printer is described below with reference to FIG. 8. FIG. 8 shows a time chart illustrating the change over time of the rotating speed of the photoconductor and the developing roller (i.e., the rotating speed), and the amount of developer carried toward the press-contact position (i.e., the carrying amount) or the amount of developer that passes the press-contact position (i.e., the passing amount), and the build-up amount of the drift of liquid (which is also referred to simply as "liquid-drift amount" below). The time chart includes three figures: the upper figure shows the change over time of the rotating speed, the central figure shows the change over time of the carrying amount or the passing amount, and the lower figure shows the change over time of the liquid-drift amount. In the time chart, the horizontal axis indicates time, the vertical axis in the upper figure indicates the rotating speed, the vertical axis in the central figure indicates the layer thickness of developer which indicates the amount of developer carried toward the press-contact position (i.e., the carrying amount) or the amount of developer that passes the press-contact position (i.e., the passing amount), and the vertical axis in the lower figure indicates the liquid-drift amount. Further, a thin line and a bold line are shown in the central figure: the former indicates the change over time of the carrying amount, and the latter indicates the change over time of the passing amount.

Consideration on how the rotating speed, the carrying amount, the passing amount, and the liquid-drift amount change over time is made below. The time chart of FIG. 8 starts from when the printer is carrying out image formation. Therefore, at time "0" of the horizontal axis, the rotating speed is at the "predetermined rotating speed for development" described above (which is 200 mm/sec in the present example). At time "0", the passing amount is approximately 14 μm as derived from FIG. 6. This passing amount is above the carrying amount (12 μm), and therefore, no drift of liquid is created.

Next, after confirming that there are no more inputs, such as image signals, from the host computer, the printer starts, at time "t1", deceleration of the rotating speed of the photoconductor and the developing roller to stop the photoconductor and the developing roller. As described above, the passing amount decreases along with the decrease in the rotating speed, whereas the carrying amount stays constant. Therefore, eventually, the passing amount and the carrying amount coincide at time "t2". By further decreasing the rotating speed, the passing amount falls below the carrying amount, and a drift of liquid starts to build up. From time "t2" until when the photoconductor and the developing roller come to a stop (time "t3") the drift of liquid keeps building up. In other words, when the photoconductor and the developing roller rotate at a rotating speed that is slower than the rotating speed for development, the passing amount becomes smaller than the carrying amount and therefore a drift of liquid is created.

When the photoconductor and the developing roller come to a stop, the printer enters a standby state (from time "t3" to "t4"). Although the drift of liquid will not build up during this standby state because the photoconductor and the developing roller are in a stopped state, the printer still has the drift of liquid that has built up during the period from time "t2" to "t3".

When the printer, which is in a standby state, receives an input of image signals etc. from the host computer, the photoconductor and the developing roller start rotating again (time "t4"). The printer accelerates the rotating speed of the photoconductor and the developing roller such that the rotating speed of the photoconductor and the developing roller reaches the rotating speed for development. Although the passing amount increases along with the increase in the rotating speed, the drift of liquid still keeps building up until the passing amount and the carrying amount become the same at time "t5".

Effect of Starting Development after a Predetermined Period of Time has Passed from when the Rotating Speed Reached the Rotating Speed for Development According to the First Example As described above, in the present example, development of a latent image is started after a predetermined period of time has passed from when the rotating speed (which is an example of a "turning speed") of the photoconductor and the developing roller reached the rotating speed for development (which is an example of a "predetermined turning speed for development"). In this way, it becomes possible to appropriately prevent deterioration of image quality.

Reference is again made to FIG. 8. When the passing amount and the carrying amount become the same at time "t5", the drift of liquid stops building up. As the rotating speed is further increased, the passing amount exceeds the carrying amount, and the developer carried toward the press-contact position, as well as the drift of liquid that built up at the press-contact position, start passing the press-contact position. Therefore, the amount of the drift of liquid keeps decreasing after time "t5". However, it is not possible to eliminate all of the drift of liquid that built up at the press-contact position before the rotating speed reaches the rotating speed for development (before time "t6"). Therefore, some of the drift of liquid still remains at the press-contact position when the rotating speed reaches the rotating speed for development (at time "t6").

Therefore, if development of a latent image is started at the time when the rotating speed of the photoconductor and the developing roller reaches the rotating speed for development (at time "t6"), development will be carried out in a state in which the drift of liquid still exists. This gives rise to fogging, unevenness in darkness, etc., of the image that is formed on the medium, thereby causing deterioration of image quality.

In view of the above, development is not started right after the rotating speed has reached the rotating speed for development (i.e., is not started right after time "t6"), but is instead started after a predetermined period of time has passed from time "t6" (i.e., is started at time "t8"). As described above, in the present example, after the rotating speed has reached the rotating speed for development (at time "t6"), the rotating speed is maintained at the rotating speed for development. In this state, the passing amount exceeds the carrying amount, and therefore, the amount of the drift of liquid keeps decreasing. As a result, eventually, the drift of liquid that built up at the press-contact position is completely eliminated at time "t7".

By starting development at time "t8" after completion of elimination of the drift of liquid, development will be carried out in a state where there is no drift of liquid. Thus, it becomes possible to appropriately prevent occurrence of fogging, unevenness in darkness, etc., of the image that is formed on the medium and prevent deterioration of image quality.

Second Example of Operations of the Printer 10

Next, a second example of image-forming operations of the printer 10, which is structured as above, is described below.

When image signals and control signals are input from the not-shown host computer to the main controller 101 of the printer 10 through the interface (I/F) 112, the photoconductors 20Y, 20M, 20C, and 20K and the developing rollers etc. provided in the respective developing units 50Y, 50M, 50C, and 50K start rotating under the control of the unit controller 102 according to the instructions from the main controller 101. While being rotated, the photoconductors 20Y, 20M, 20C, and 20K are successively charged, respectively, by the charging units 30Y, 30M, 30C, and 30K at respective charging positions.

With the rotation of the photoconductors 20Y, 20M, 20C, and 20K, the charged area of each of the photoconductors 20Y, 20M, 20C, and 20K reaches an exposing position. A latent image that corresponds to the image information for yellow Y, magenta M, cyan C, and black K is formed, respectively, in the charged area of the respective photoconductors by the respective exposing units 40Y, 40M, 46C, and 40K.

With the rotation of the photoconductors 20Y, 20M, 20C, and 20K, the latent image formed on the respective photoconductors 20Y, 20M, 20C, and 20K reaches the developing position, and is developed, respectively, by the respective developing units 50Y, 50M, 50C, and 50K. Thus, a developer image is formed on each of the photoconductors 20Y, 20M, 20C, and 20K.

The latent-image developing operation of the developing units 50Y, 50M, 50C, and 50K is now described in detail. It should be noted that, as described above, although the printer 10 has, as developing units, a black developing unit 50K, a magenta developing unit 50M, a cyan developing unit 50C, and a yellow developing unit 50Y, only the yellow developing unit 50Y is described in detail below because the developing operation of each developing unit is substantially the same.

In the yellow developing unit 50Y, the developer drawing roller 540 rotates about its central axis to draw up the developer D contained in the developer containing section 530 and carry it to the developer supplying roller 550.

With the rotation of the developer supplying roller 550, the developer D that has been carried to the developer supplying roller 550 reaches an abutting position where the restriction blade 560 abuts against the roller 550. As the developer D on the roller 550 passes the abutting position, an excessive portion of the developer D is scraped off by the restriction blade 560, and thus, the amount of developer D to be supplied to the developing roller 510 is measured. That is, since the developer supplying roller 550 is provided with the grooves 550*a* as described above, the restriction blade 560, which abuts against the developer supplying roller 550, scrapes off the developer D on the developer supplying roller 550 except for the developer D that is retained in the grooves 550*a*. The dimension of the grooves 550*a* is determined in advance such that the amount of developer D to be supplied to the developing roller 510 becomes appropriate, so that when the restriction blade 560 scrapes off the developer D on the developer supplying roller 550, an appropriate amount of developer D, which has been suitably measured by means of the grooves 550*a*, will remain in the grooves 550*a*.

With further rotation of the developer supplying roller 550, the developer D retained in the grooves 550*a* of the developer supplying roller 550 reaches a press-contact position where the roller 550 is pressed in contact with the developing roller 510. The developer D that has reached the press-contact position is transferred from the developer supplying roller 550 onto the developing roller 510 by the action of a pressure that is created as a result of the developer supplying roller 550 and the developing roller 510 being pressed in contact with each other, thereby forming a thin layer of developer D on the developing roller 510.

The thin layer of developer D formed on the developing roller 510 in this way is carried, by the rotation of the developing roller 510, toward a press-contact position (i.e., the developing position in opposition to the photoconductor 20Y) where the roller 510 abuts against the photoconductor 20Y. The thin layer of developer D carried toward the press-contact position is used, at the press-contact position, for development of the latent image formed on the photoconductor 20Y under an electric field of a predetermined intensity, and thus, a developer image is formed on the photoconductor 20Y.

It should be noted that although the photoconductor 20Y and the developing roller 510 start to rotate when image signals etc. from the host computer are input to the printer 10 as described above, the printer 10 starts development of the latent image after it increases the rotating speed of the photoconductor 20Y and the developing roller 510 so that the rotating speed reaches a predetermined value (i.e., a "predetermined rotating speed for development"). Further, in the present second example, the printer 10 causes the developing roller 510 and the photoconductor 20Y to rotate, before starting of the development of the latent image, for a predetermined period of time at a rotating speed that is faster than the predetermined rotating speed for development. In the present second example, the printer 10 further increases the rotating speed after the rotating speed of the photoconductor 20Y and the developing roller 510 has reached the rotating speed for development. Then, the printer 10 decreases the rotating speed, and starts development of the latent image when the rotating speed again reaches the rotating speed for development.

Further, with further rotation of the developing roller 510, the developer D on the developing roller 510 that has passed the developing position reaches an abutting position where the developing-roller cleaning blade 571 abuts against the roller 510. When passing the abutting position, the developer D adhering to the surface of the developing roller 510 is scraped off by the developing-roller cleaning blade 571, and the scraped-off developer D is collected in a remaining-developer collector of the developing-roller cleaning unit 570.

With the rotation of the photoconductors 20Y, 20M, 20C, and 20K, the developer images formed on the respective photoconductors 20Y, 20M, 20C, and 20K reach their respective first transferring positions, and are transferred onto the intermediate transferring body 70 by the respective first transferring units 60Y, 60M, 60C, and 60K. At this time, a first transferring voltage, which is in an opposite polarity to the polarity to which the developer is charged, is applied to the first transferring units 60Y, 60M, 60C, and 60K. As a result, the developer images in four colors formed respectively on each photoconductor 20Y, 20M, 20C, and 20K are transferred onto the intermediate transferring body 70 in a superposed manner, thereby forming a full-color developer image on the intermediate transferring body 70.

With the rotation of the intermediate transferring body 70, the full-color developer image formed on the intermediate transferring body 70 reaches a second transferring position, and is transferred onto a medium by the second transferring unit 80. It should be noted that the medium is carried from a paper supply tray, which is not shown in the figure, to the second transferring unit 80 by means of various rollers. (The arrow in FIG. 1 indicates the direction in which the medium is carried.) During transferring operations, a second transferring voltage is applied to the second transferring unit 80 and also the unit 80 is pressed against the intermediate transferring body 70.

The full-color developer image transferred onto the medium is heated and pressurized by the fusing unit and fused to the medium.

On the other hand, after the photoconductors 20Y, 20M, 20C, and 20K have passed their respective first transferring positions, the electric charge is eliminated by the respective static eliminating units 73Y, 73M, 73C, and 73K, and the developer adhering to the surface of each photoconductor 20Y, 20M, 20C, and 20K is scraped off by the respective photoconductor cleaning blades 76Y, 76M, 76C, and 76K that are supported on the respective photoconductor cleaning units 75Y, 75M, 75C, and 75K. In this way, the photoconductor 20 is prepared for charging for the next latent image to be formed. The scraped-off developer is collected in a remaining-developer collector of the respective photoconductor cleaning units 75Y, 75M, 75C, and 75K.

After confirming that there are no more image signals etc. from the host computer, the printer 10 decreases the rotating speed of the photoconductor, the developing roller, etc., to bring the photoconductor, the developing roller, etc., to a stop. The printer 10 then enters a standby state and waits for the next image formation.

Second Example of Mechanism According To Which Drift of Liquid is Created

As described in the section of the "Description of the Related Art", there are situations in which a drift of liquid is created at the press-contact position when the developer bore by the developing roller is carried toward the press-contact position by the rotation of the developing roller. Below, the mechanism according to which this drift of liquid is created is described with reference to FIG. 9 through FIG. 11.

Figure 9:
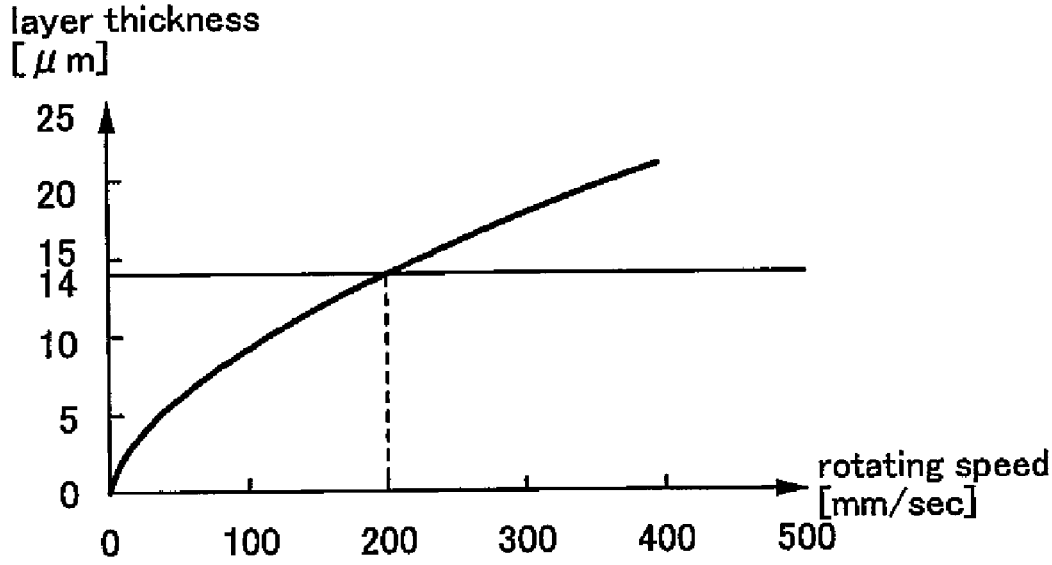
FIG. 9 is a diagram showing a second example of a relationship between the rotating speed of the photoconductor and the developing roller, and the amount of developer carried toward the press-contact position or the amount of developer that passes the press-contact position.

First, attention is paid to FIG. 9. FIG. 9 is a diagram showing a relationship between the rotating speed of the photoconductor and the developing roller (which is also referred to simply as "rotating speed" below), and the amount of developer carried toward the above-mentioned press-contact position (which is also referred to simply as "carrying amount" below) or the amount of developer that can pass the press-contact position (which is also referred to simply as "passing amount" below). In this figure, the horizontal axis indicates the rotating speed, and the vertical axis indicates the layer thickness (i.e., the thickness of the thin layer of developer on the developing roller) which indicates either the amount of developer carried toward the press-contact position or the amount of developer that passes the press-contact position. One straight line and one curved line are shown in the figure: the former indicates a relationship between the rotating speed and the carrying amount, and the latter indicates a relationship between the rotating speed and the passing amount.

Taking FIG. 9 into consideration, it is found that the thickness of the layer of developer carried toward the press-contact position (i.e., the carrying amount) takes a constant value regardless of the rotating speed, because the carrying amount is not dependent on the rotating speed. In the present example, the constant value is approximately 14 μm. On the other hand, as shown in FIG. 9, the thickness of the layer of developer that can pass the press-contact position (i.e., the passing amount) becomes smaller as the rotating speed becomes slower, as known from the relational equation according to the elasto-hydrodynamic lubrication theory described in Equation 5 of above-mentioned JP 2003-76148 A.

Figure 10:
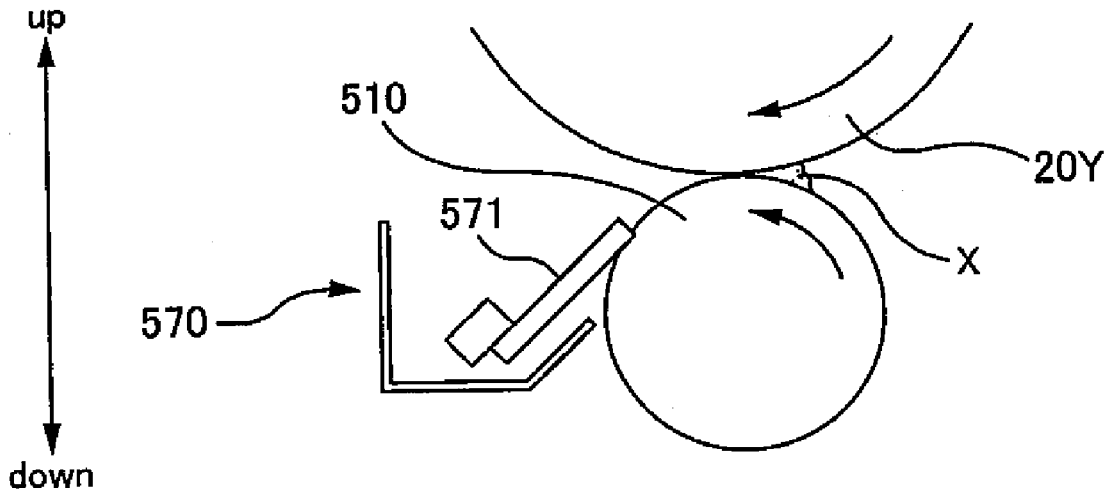
FIG. 10 is a conceptual diagram showing how a drift of liquid is created at the press-contact position according to the second example.

According to these relationships, the following can be derived. That is, when the thickness of the layer of developer that passes the press-contact position (i.e., the passing amount) is smaller than the thickness of the layer of developer carried toward the press-contact position (i.e., the carrying amount) due to the rotating speed being slow, a situation is caused in which some of the developer cannot pass the press-contact position even though it has been carried thereto. As indicated by the mark "X" in FIG. 10, the developer that could not pass the press-contact position builds up around the press-contact position (particularly around the entrance), and a drift of liquid is created. It should be noted that FIG. 10 is a conceptual diagram showing how a drift of liquid is created at the press-contact position.

Figure 11:
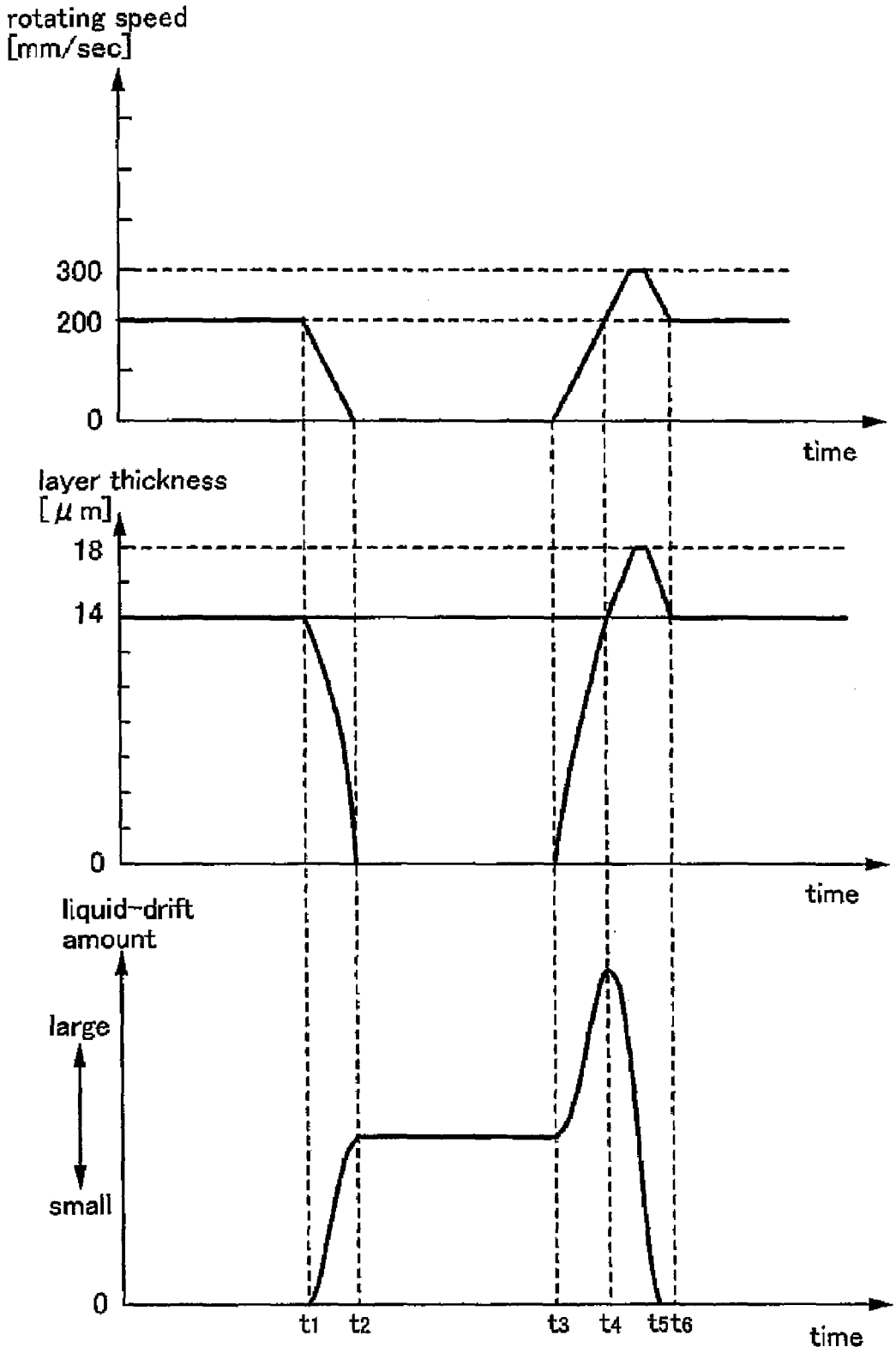
FIG. 11 shows a time chart illustrating the change over time of the rotating speed of the photoconductor and the developing roller, and the amount of developer carried toward the press-contact position or the amount of developer that passes the press-contact position, and the build-up amount of the drift of liquid.

Next, the timing at which the above-described situation occurs during the operations of the printer is described below with reference to FIG. 11. FIG. 11 shows a time chart illustrating the change over time of the rotating speed of the photoconductor and the developing roller (i.e., the rotating speed), and the amount of developer carried toward the press-contact position (i.e., the carrying amount) or the amount of developer that passes the press-contact position (i.e., the passing amount), and the build-up amount of the drift of liquid (which is also referred to simply as "liquid-drift amount" below). The time chart includes three figures: the upper figure shows the change over time of the rotating speed, the central figure shows the change over time of the carrying amount or the passing amount, and the lower figure shows the change over time of the liquid-drift amount. In the time chart, the horizontal axis indicates time, the vertical axis in the upper figure indicates the rotating speed, the vertical axis in the central figure indicates the layer thickness of developer which indicates the amount of developer carried toward the press-contact position (i.e., the carrying amount) or the amount of developer that passes the press-contact position (i.e., the passing amount), and the vertical axis in the lower figure indicates the liquid-drift amount. Further, a thin line and a bold line are shown in the central figure: the former indicates the change over time of the carrying amount, and the latter indicates the change over time of the passing amount. It should be noted that the value between time "0" through time "t1" and the value from time "t6" and on are the same.

Consideration on how the rotating speed, the carrying amount, the passing amount, and the liquid-drift amount change over time is made below. The time chart of FIG. 11 starts from when the printer is carrying out image formation. Therefore, at time "0" of the horizontal axis, the rotating speed is at the "predetermined rotating speed for development" described above (which is 200 mm/sec in the present example). At time "0", the passing amount is approximately 14 μm as derived from FIG. 9. This passing amount is the same as the carrying amount (14 μm), and therefore, no drift of liquid is created.

Next, after confirming that there are no more inputs, such as image signals, from the host computer, the printer starts, at time "t1", deceleration of the rotating speed of the photoconductor and the developing roller to stop the photoconductor and the developing roller. As described above, the passing amount decreases along with the decrease in the rotating speed, whereas the carrying amount stays constant. Therefore, from time "t1", the passing amount drops below the carrying amount, and therefore, a drift of liquid starts to build up. The drift of liquid keeps building up until when the photoconductor and the developing roller come to a stop (time "t2"). In other words, when the photoconductor and the developing roller rotate at a rotating speed that is slower than the rotating speed for development, the passing amount becomes smaller than the carrying amount and therefore a drift of liquid is created.

When the photoconductor and the developing roller come to a stop, the printer enters a standby state (from time "t2" to "t3"). Although the drift of liquid will not build up during this standby state because the photoconductor and the developing roller are in a stopped state, the printer still has the drift of liquid that has built up during the period from time "t1" to "t2".

When the printer, which is in a standby state, receives an input of image signals etc. from the host computer, the photoconductor and the developing roller start rotating again (time "t3"). The printer accelerates the rotating speed of the photoconductor and the developing roller such that the rotating speed of the photoconductor and the developing roller reaches the rotating speed for development. Although the passing amount increases along with the increase in the rotating speed, the drift of liquid still keeps building up until the passing amount and the carrying amount become the same at time "t4".

Effect Of Rotating Developing Roller And Photoconductor, Before Starting Development, for a Predetermined Period of Time at a Rotating Speed that is Faster than the Rotating Speed for Development According to the Second Example As described above, in the present second example, the developing roller and the photoconductor are rotated, before starting of the development of the latent image, for a predetermined period of time at a rotating speed (which is an example of a "turning speed") that is faster than the predetermined rotating speed for development (which is an example of a "predetermined turning speed for development"). In this way, it becomes possible to appropriately prevent deterioration of image quality.

Reference is again made to FIG. 11. When the printer increases the rotating speed of the photoconductor and the developing roller, the rotating speed eventually reaches the rotating speed for development (at time "t4"). As described above, in the printer according to the present example, the passing amount becomes the same as the carrying amount when the rotating speed reaches the rotating speed for development. Therefore, the drift of liquid stops building up at this timing (at time "t4"), but the drift of liquid that built up during time "t1" through "t4" still remains at the press-contact position.

Therefore, if development of the latent image is started at the time when the rotating speed reaches the rotating speed for development (i.e., at time "t4"), then development will be carried out in a state in which the drift of liquid still exists. Further, since it is not possible to reduce the amount of drift of liquid remaining at the press-contact position when the passing amount and the carrying amount are the same, development will anyhow be carried out in the same state (i.e., the state in which the drift of liquid still exists) even if development is started after lapse of a predetermined period of time without changing the rotating speed from the rotating speed for development. If development is carried out in a state in which the drift of liquid still exists, then fogging, unevenness in darkness, etc., of the image that is formed on the medium may occur, and these may cause deterioration of image quality.

In view of the above, the developing roller and the photoconductor are rotated, before starting of the development of the latent image, for a predetermined period of time at a rotating speed that is faster than the predetermined rotating speed for development. More specifically, the printer further increases the rotating speed after when the rotating speed reaches the rotating speed for development (after time "t4"). Then, the printer decreases the rotating speed, and then starts development of the latent image when the rotating speed comes down to the rotating speed for development (at time "t6").

The passing amount exceeds the carrying amount while the developing roller and the photoconductor are rotating at a rotating speed that is faster than the rotating speed for development. Therefore, the developer carried toward the press-contact position, as well as the drift of liquid that built up at the press-contact position, start passing the press-contact position. Thus, during this period of time, the amount of the drift of liquid keeps decreasing, and at time "t5", all of the drift of liquid that built up at the press-contact position can be eliminated.

Then, by starting development at time "t6", development will be carried out in a state where there is no drift of liquid. Thus, it becomes possible to appropriately prevent occurrence of fogging, unevenness in darkness, etc., of the image that is formed on the medium and prevent deterioration of image quality.

It should be noted that in the present second example, the rotating speed is increased up to 300 mm/sec, and the passing amount at this speed is approximately 18 μm, as shown in FIG. 11.

OTHER EMBODIMENTS

In the foregoing, an image forming apparatus etc. according to the present invention was described according to the above-described embodiments thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

In the foregoing embodiment, an intermediate transferring type full-color laser beam printer was described as an example of the image forming apparatus, but the present invention is also applicable to full-color laser beam printers that are not of the intermediate transferring type. Further, other than full-color laser printers, the present invention is also applicable to monochrome laser beam printers. Furthermore, other than printers, the present invention is also applicable to various other types of image forming apparatuses such as copying machines and facsimiles.

Further, the photoconductor is not limited to the so-called "photoconductive roller" structured by providing a photoconductive layer on the outer peripheral surface of a cylindrical base. The photoconductor can be, for example, a so-called "photoconductive belt" structured by providing a photoconductive layer on a surface of a belt-like base.

Further, in the foregoing embodiment, the restriction blade 560 was arranged such that its tip end faced toward the downstream side of the rotating direction of the developer supplying roller 550, and thus, carried out a so-called "trailing restriction". This, however, is not a limitation. For example, the restriction blade may be arranged such that its tip end faces toward the upstream side of the rotating direction of the developer supplying roller, thus carrying out a so-called "counter restriction".

Further, in the first example of the foregoing embodiment, the rotating speed of the photoconductor and the developing roller was maintained at the predetermined rotating speed for development from when the rotating speed reached the predetermined rotating speed for development. It is possible, however, to further increase the rotating speed after the rotating speed reaches the predetermined rotating speed for development, then decrease the rotating speed, and start development of the latent image when the rotating speed comes down to the predetermined rotating speed for development.

If the rotating speed is increased after the rotating speed reaches the rotating speed for development, then the drift of liquid will be eliminated at an earlier timing. Therefore, in this way, an advantage of being able to start appropriate development in a short amount of time from when the rotating speed reached the rotating speed for development can be achieved.

Further, the second example of the foregoing embodiment was about a case in which the passing amount became the same as the carrying amount when the rotating speed reached the predetermined rotating speed for development. This, however, is not a limitation. For example, the present invention is applicable to situations in which the passing amount is above the carrying amount when the rotating speed reaches the predetermined rotating speed for development.

Further, the foregoing embodiment was about an example in which the passing amount became smaller than the carrying amount and a drift of liquid was created when the developing roller and the photoconductor rotated at a rotating speed that is slower than the rotating speed for development. This, however, is not a limitation.

As derived from the relational equation according to the elastohydrodynamic lubrication theory described above, the passing amount becomes smaller as the viscosity of the developer becomes lower. Therefore, the present invention is applicable to situations in which the viscosity of the developer decreases due to environmental changes and a drift of liquid is created due to this decrease in viscosity.

Further, in the foregoing embodiment, the developer bearing body was a developing roller 510. This, however, is not a limitation. For example, the developer bearing body may be a developing belt having a belt-like shape.

Further, in the foregoing embodiment, the developing roller 510 and each photoconductor 20Y, 20M, 20C, and 20K were structured to be rotatable. This, however, is not a limitation. For example, the developing roller and the photoconductors may be turnable, but not rotatable.

The foregoing embodiment, however, is more preferable in terms that it is possible to efficiently develop the latent image bore by the photoconductor with the developer bore by the developing roller.

Further, in the foregoing embodiment, the developing roller 510 had a layer of an elastic body, and each photoconductor 20Y, 20M, 20C, and 20K was pressed in contact with the respective layer of elastic body. This, however, is not a limitation.

Further, in the foregoing embodiment, the rotating speed of the developing roller 510 was equal to the rotating speed of the photoconductors 20Y, 20M, 20C, and 20K. This, however, is not a limitation. For example, the rotating speeds may be different from each other.

The foregoing embodiment, however, is more preferable in terms that rotation control is easier.

Further, in the foregoing embodiment, the rotating direction of the developing roller 510 was opposite from the rotating direction of each of the photoconductors 20Y, 20M, 20C, and 20K. This, however, is not a limitation. For example, the rotating direction of the developing roller may be in the same direction as the rotating direction of the photoconductor.

However, when the rotating direction of the developing roller is in the same direction as the rotating direction of the photoconductor, an excessive rotational resistance occurs at the press-contact sections because the developing roller and the photoconductor rotate while being pressed in contact with each other. Therefore, it is more preferable that the rotating direction of the developing roller 510 is opposite from the rotating direction of each of the photoconductors 20Y, 20M, 20C, and 20K in terms that the above-described disadvantage does not arise.

Further, in the foregoing embodiment, non-volatile liquid developer that is non-volatile at room temperature was used as the developer. This, however, is not a limitation. For example, the developer may be volatile liquid developer which employs Isopar (trademark: Exxon Mobil Corporation) as a carrier, has low concentration (approximately 1 to 2 wt %) and low viscosity, and is volatile at room temperature.

Other than the countermeasure according to the present invention described above, it is possible to adopt, as a countermeasure for preventing deterioration of image quality due to the drift of liquid, a countermeasure of eliminating the drift of liquid by moving the position of either the developing roller or the photoconductor to release the press-contact between the developing roller and the photoconductor.

In cases where volatile liquid developer that is volatile at room temperature is used as the developer, the carrier may volatilize and the remaining toner particles may adhere to the press-contact position when the volatile liquid developer builds up (i.e., causes a drift of liquid) at the press-contact position. When giving consideration to such a situation, it is more effective to adopt the other countermeasure described above as the countermeasure for preventing deterioration of image quality due to drift of liquid. On the other hands this other countermeasure requires additional mechanisms for releasing the press-contact, and therefore has a disadvantage that it is more costly compared to the countermeasure according to the present invention.

Therefore, in cases where non-volatile liquid developer that is non-volatile at room temperature is used as the developer, the countermeasure according to the present invention is more effective in terms of cost reduction, because the above-mentioned situation does not occur.

Configuration of Image Forming System Etc.

Next, an embodiment of an image forming system, which serve as an example of an embodiment of the present invention, is described with reference to the drawings.

Figure 12:
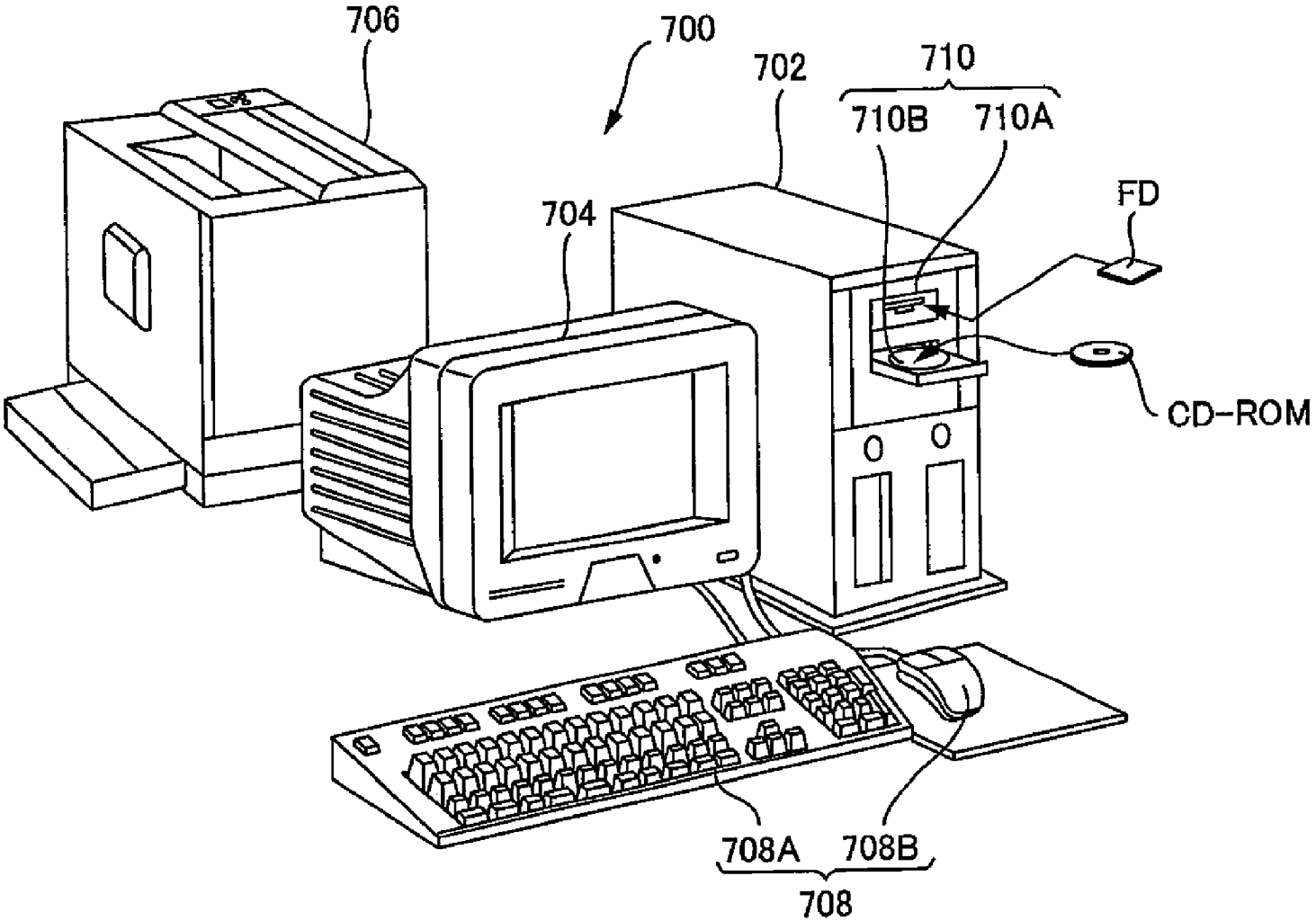
FIG. 12 is an explanatory drawing showing an external structure of an image forming system.

FIG. 12 is an explanatory drawing showing an external structure of an image forming system. The image forming system 700 comprises a computer 702, a display device 704, a printer 706, an input device 708, and a reading device 710. In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 13:
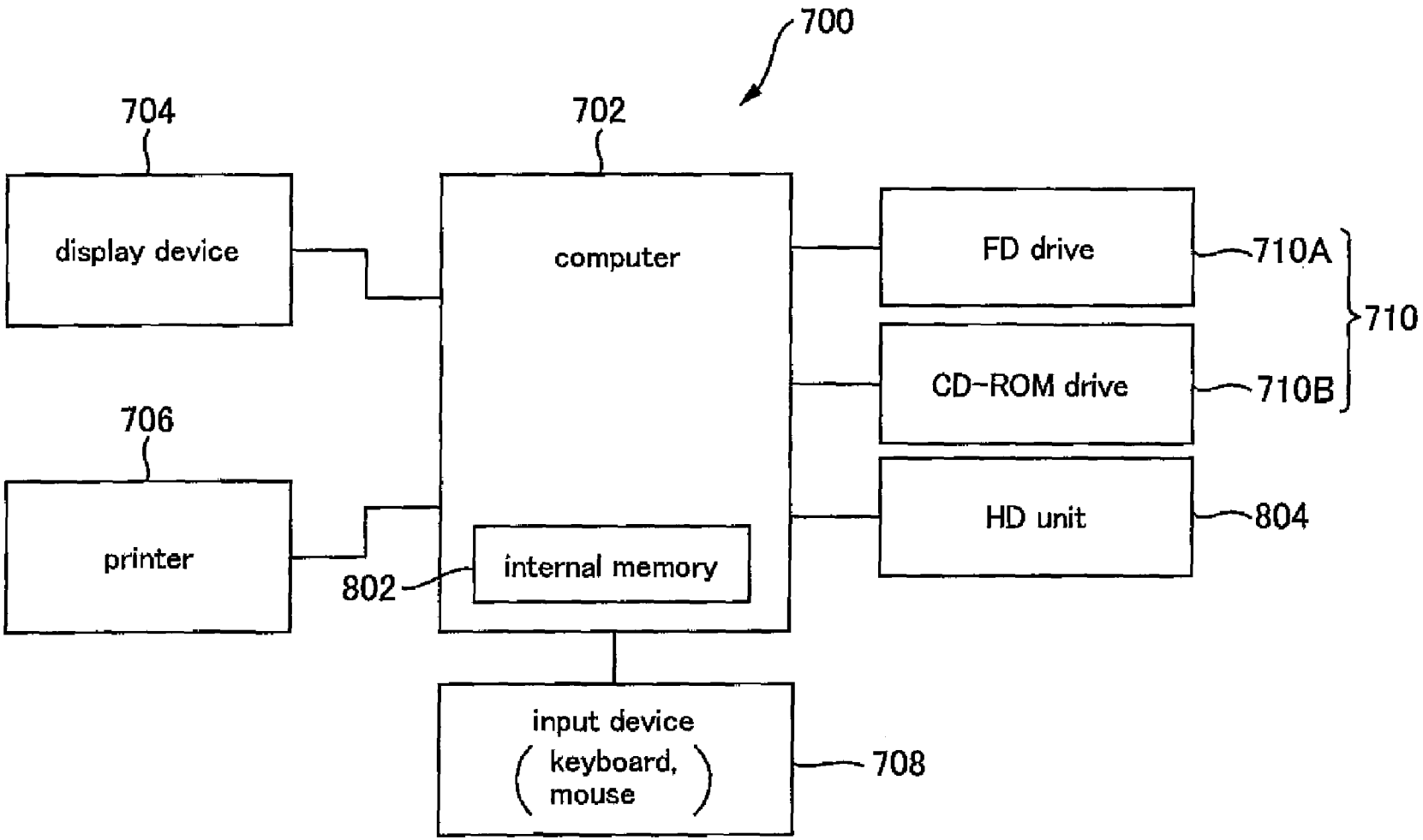
FIG. 13 is a block diagram showing a configuration of the image forming system shown in FIG. 12.

FIG. 13 is a block diagram showing a configuration of the image forming system shown in FIG. 12. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to comprise any one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. An image forming method comprising:

causing an image bearing body for bearing a latent image and a developer bearing body for bearing liquid developer to increase in speed to a predetermined turning speed in a state where said image bearing body and said developer bearing body are pressed in contact with each other;

causing said image bearing body and said developer bearing body to turn for a period of time necessary to eliminate drift of liquid;

causing said development of said latent image to start with said liquid developer; and after said development ends, causing said image bearing member and said developer bearing body to stop by decreasing in speed in a state where said image bearing body and said developer bearing body are pressed in contact with each other.

2. An image forming method according to claim 1 comprising:

causing said turning speed to increase to a second turning speed, after said developer bearing body and said image bearing body are caused to increase in speed to the predetermined turning speed; and causing said developer bearing body and said image bearing body to decrease in speed to the predetermined turning speed, after reaching a second turning speed.

3. An image forming method according to claim 1, wherein said image bearing body and said developer bearing body stop in a state pressed in contact with each other, and enter a standby state.

4. An image forming method according to claim 1, wherein at the time an image signal is input, said developer bearing body and said image bearing body start turning.

5. An image forming method according to claim 1, wherein said liquid developer is non-volatile developer that is non-volatile at room temperature.

6. An image forming apparatus comprising:

an image bearing body for bearing a latent image;

a developer bearing body for bearing liquid developer; and a controller that causes said image bearing body and said developer bearing body to increase in speed to a predetermined turning speed in a state where said image bearing body and said developer bearing body are pressed in contact with each other, that causes said image bearing body and said developer bearing body to turn for a period of time necessary to eliminate drift of liquid;

that causes said development of said latent image to start with said liquid developer; and after said development ends, that causes said image bearing member and said developer bearing body to stop by decreasing in speed in a state where said image bearing body and said developer bearing body are pressed in contact with each other.

7. An image forming apparatus according to claim 6 comprising:

a developer supplying roller that supplies liquid developer to the developer bearing body, said developer supplying roller having groove; and a restriction blade that abuts against said developer supplying roller.

8. An image forming apparatus according to claim 6, wherein said liquid developer is non-volatile developer that is non-volatile at room temperature.

* * * * *